US007510439B2

(12) United States Patent
Gordon et al.

(10) Patent No.: US 7,510,439 B2
(45) **Date of Patent: *Mar. 31, 2009**

(54) SHIELDED JACK ASSEMBLIES AND METHODS FOR FORMING A CABLE TERMINATION

(75) Inventors: W. Andrew Gordon, Allen, TX (US); Michael Walter Canning, Plano, TX (US); Robert R. Goodrich, Indianapolis, IN (US)

(73) Assignee: CommScope, Inc. of North Carolina, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/766,450

(22) Filed: Jun. 21, 2007

(65) Prior Publication Data

US 2007/0287332 A1 Dec. 13, 2007

Related U.S. Application Data

(63) Continuation of application No. 11/431,774, filed on May 10, 2006, now Pat. No. 7,249,974, which is a continuation of application No. 11/137,063, filed on May 25, 2005, now Pat. No. 7,083,472.

(60) Provisional application No. 60/578,730, filed on Jun. 10, 2004.

(51) Int. Cl.
*H01R 9/03* (2006.01)

(52) U.S. Cl. ..... 439/610; 439/931

(58) Field of Classification Search ..... 439/610, 439/931, 88

See application file for complete search history.

(56) References Cited

U.S. PATENT DOCUMENTS

| | | | | |
|---|---|---|---|---|
| 3,708,779 | A | 1/1973 | Enright et al. | |
| 4,146,291 | A * | 3/1979 | Goff et al. | 439/90 |
| 4,767,355 | A | 8/1988 | Philippson et al. | |
| 4,783,906 | A | 11/1988 | Gingerich et al. | |

(Continued)

FOREIGN PATENT DOCUMENTS

| | | |
|---|---|---|
| DE | 41 09 863 | 10/1992 |

(Continued)

OTHER PUBLICATIONS

Jackson, Brian C. and Thomas W. Bleeks, "Performance characteristics of conductive coatings for EMI control", Item 1999.

(Continued)

*Primary Examiner*—Neil Abrams
*Assistant Examiner*—Phuong Nguyen
(74) *Attorney, Agent, or Firm*—Myers Bigel Sibley & Sajovec, PA

(57) ABSTRACT

A jack assembly for use with a modular electrical plug includes a jack housing. The jack housing includes an electrically non-conductive substrate metalized with a metal shield layer. The jack housing defines a socket adapted to receive the plug. At least one electrical contact is positioned in the socket to engage the plug when the plug is inserted in the socket. An electrically conductive jumper member including a drain wire connector may be mounted on the jack housing. The drain wire connector includes a pair of connector tabs defining a slot therebetween to receive and hold the drain wire.

17 Claims, 9 Drawing Sheets

U.S. PATENT DOCUMENTS

| | | | | | |
|---|---|---|---|---|---|
| 4,867,692 | A | * | 9/1989 | Kerek | 439/101 |
| 4,889,503 | A | | 12/1989 | Philippson et al. | |
| 4,941,848 | A | | 7/1990 | Philippson et al. | |
| 4,969,836 | A | | 11/1990 | Magnier et al. | |
| 5,035,649 | A | | 7/1991 | Collier et al. | |
| 5,059,140 | A | | 10/1991 | Philippson et al. | |
| 5,118,306 | A | | 6/1992 | Bixler et al. | |
| 5,169,346 | A | | 12/1992 | Johnston | |
| 5,199,891 | A | * | 4/1993 | Reed | 439/98 |
| 5,268,820 | A | | 12/1993 | Tseng et al. | |
| 5,358,430 | A | | 10/1994 | Bonvallat et al. | |
| 5,364,292 | A | * | 11/1994 | Bethurum | 439/610 |
| 5,529,506 | A | | 6/1996 | Onoda | |
| 5,538,440 | A | | 7/1996 | Rodrigues et al. | |
| 5,571,035 | A | | 11/1996 | Ferrill | |
| 5,658,170 | A | | 8/1997 | Tan et al. | |
| 5,688,145 | A | | 11/1997 | Liu | |
| RE35,832 | E | * | 6/1998 | Perkins | 361/220 |
| 5,906,513 | A | | 5/1999 | Peterson et al. | |
| 6,010,367 | A | | 1/2000 | Wu | |
| 6,425,781 | B1 | | 7/2002 | Bernstein et al. | |
| 6,464,529 | B1 | | 10/2002 | Jensen et al. | |
| 6,579,116 | B2 | * | 6/2003 | Brennan et al. | 439/418 |
| 6,722,898 | B2 | | 4/2004 | Peloza et al. | |
| 6,743,028 | B2 | | 6/2004 | Wang | |
| 6,860,749 | B1 | | 3/2005 | Wu | |
| 6,917,255 | B2 | * | 7/2005 | Mathias et al. | 333/25 |
| 6,971,899 | B1 | | 12/2005 | Liu | |
| 7,004,764 | B2 | | 2/2006 | Boudreau et al. | |
| 7,033,219 | B2 | | 4/2006 | Gordon et al. | |
| 7,083,472 | B2 | * | 8/2006 | Gordon et al. | 439/610 |
| 7,249,974 | B2 | * | 7/2007 | Gordon et al. | 439/610 |
| 2003/0060084 | A1 | | 3/2003 | Aoki | |
| 2003/0228799 | A1 | | 12/2003 | Machado et al. | |
| 2004/0266266 | A1 | | 12/2004 | Lai | |
| 2005/0277340 | A1 | | 12/2005 | Gordon et al. | |

FOREIGN PATENT DOCUMENTS

| | | | |
|---|---|---|---|
| EP | 1024561 | A2 | 8/2000 |
| EP | 1024561 | A3 | 8/2000 |
| EP | 1 128 488 | | 8/2001 |
| GB | 2 243 033 | | 10/1991 |
| GB | 2 313 241 | | 11/1997 |
| JP | 2002017019 | A | 1/2002 |
| JP | 2003077593 | A | 3/2003 |
| TW | 573839 | | 1/2004 |
| WO | WO 03/034549 | A1 | 4/2003 |

OTHER PUBLICATIONS

Invitation to Pay Additional Fees and Partial International Search Report for PCT Application No. PCT/US2005/018713 mailed on Nov. 1, 2005.

Notification of Transmittal of the International Search Report and the Written Opinion of the International Searching Authority, or the Declaration; PCT Application No. PCT/US2005/018713 dated Jan. 9, 2006.

* cited by examiner

SHIELDED JACK ASSEMBLIES AND METHODS FOR FORMING A CABLE TERMINATION

RELATED APPLICATION(S)

The present continuation application is a continuation of U.S. patent application Ser. No. 11/431,774, filed on May 10, 2006 now U.S. Pat. No. 7,249,974, which is a continuation of U.S. patent application Ser. No. 11/137,063, filed May 25, 2005, now U.S. Pat. No. 7,083,472, issued Aug. 1, 2006, which claims priority to and the benefit of U.S. Provisional Application No. 60/578,730, filed Jun. 10, 2004, the disclosures of which are incorporated herein by reference in their entireties.

FIELD OF THE INVENTION

The present invention relates to electrical connectors and, more particularly, to shielded electrical connectors.

BACKGROUND OF THE INVENTION

Shielded transmission cables are commonly employed for the transmission of communications signals, for example, in structured cabling. Such cables may include one or more pairs of signal wires that are twisted along the length of the cable, a drain wire extending alongside the signal cables, a metal foil or braided sheath surrounding the twisted wire pair(s) and the drain wire, and an insulating jacket surrounding the wires and the metal foil or sheath. Typically, the signal wires are each covered by a respective insulation cover. Examples of cables of this type include foil-shielded twisted pair (FTP) cables (also commonly referred to as foil twisted pair or foil screened twisted pair cables). The shielding provided by the foil and the drain wire may serve to prevent radiation and signal loss and to reduce electromagnetic interference (EMI) and radiofrequency interference (RFI), and to meet electromagnetic frequency compatibility requirements. The drain wire directs extraneous signals to ground.

An FTP cable may be terminated by a connector, such as a jack, that is adapted to operatively engage a mating connector, such as a plug. The jack typically includes a nonconductive housing and a surrounding metal wrap. The drain wire of the cable is secured to the metal wrap, commonly by soldering or winding the drain wire about a post or other feature of the wrap. When a mating shielded plug is engaged with the shielded jack, the metal wrap of the jack contacts a corresponding metal wrap surrounding the plug so as to provide electrical continuity with a cable shield (e.g., foil shield) or other component connected to the wrap of the plug. The metal wrap of the jack may also serve as a continuation of the foil so that continuity of shielding is provided to and through the connection. The metal wrap of the jack may also contact a further grounded component such as a patch panel.

SUMMARY OF THE INVENTION

According to embodiments of the present invention, a jack assembly for use with a modular electrical plug includes a jack housing. The jack housing includes an electrically non-conductive substrate metalized with a metal shield layer. The jack housing defines a socket adapted to receive the plug. At least one electrical contact is positioned in the socket to engage the plug when the plug is inserted in the socket.

According to method embodiments of the present invention, a method for making a jack assembly for use with a modular electrical plug includes: metalizing an electrically non-conductive substrate to form a metalized jack housing with a metal shield layer, the jack housing defining a socket adapted to receive the plug; and positioning at least one electrical contact in the socket to engage the plug when the plug is inserted in the socket.

According to further embodiments of the present invention, a jack assembly for use with a modular electrical plug and a cable including a drain wire includes a jack housing. The jack housing defines a socket adapted to receive the plug. At least one electrical contact is positioned in the socket to engage the plug when the plug is inserted in the socket. An electrically conductive jumper member is mounted on the jack housing and includes a drain wire connector. The drain wire connector includes a pair of connector tabs defining a slot therebetween to receive and hold the drain wire.

According to further embodiments of the present invention, a jumper member for use with a jack housing and a cable, the jack housing defining a socket adapted to receive an electrical plug connector and the cable including a drain wire, is provided. The jumper member is electrically conductive and adapted to be mounted on the jack housing. The jumper member includes a drain wire connector. The drain wire connector includes a pair of connector tabs defining a slot therebetween to receive and hold the drain wire.

According to further method embodiments of the present invention, a method for providing a cable termination includes providing a jack assembly including: a jack housing defining a socket adapted to receive the plug; at least one electrical contact positioned in the socket to engage the plug when the plug is inserted in the socket; and an electrically conductive jumper member mounted on the jack housing and including a drain wire connector, the drain wire connector including a pair of connector tabs defining a slot therebetween to receive and hold the drain wire. The method further includes connecting a cable to the jack assembly, including inserting a drain wire of the cable into the slot of the drain wire connector.

According to further embodiments, a jack assembly for use with a modular electrical plug includes a jack housing including a metal-filled polymer. The jack housing defines a socket adapted to receive the plug. At least one electrical contact is positioned in the socket to engage the plug when the plug is inserted in the socket.

According to further embodiments of the invention, a method for making a jack assembly for use with a modular electrical plug includes: forming a jack housing including a metal-filled polymer, the jack housing defining a socket adapted to receive the plug; and positioning at least one electrical contact in the socket to engage the plug when the plug is inserted in the socket.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
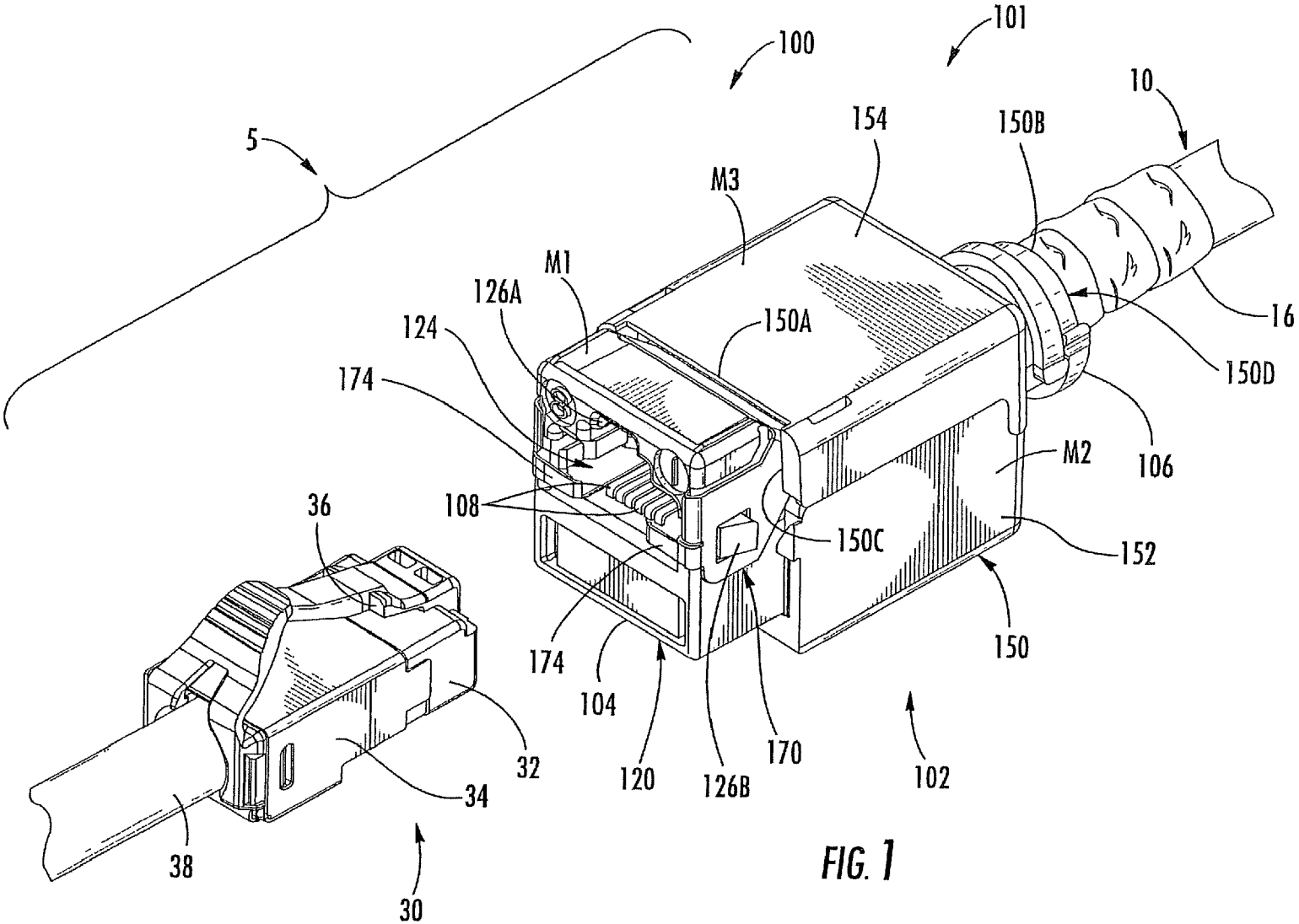
FIG. 1 is a front, perspective view of a connector system according to embodiments of the present invention, wherein a plug and a jack assembly of the connector system are shown in an uncoupled position.
Figure 2:
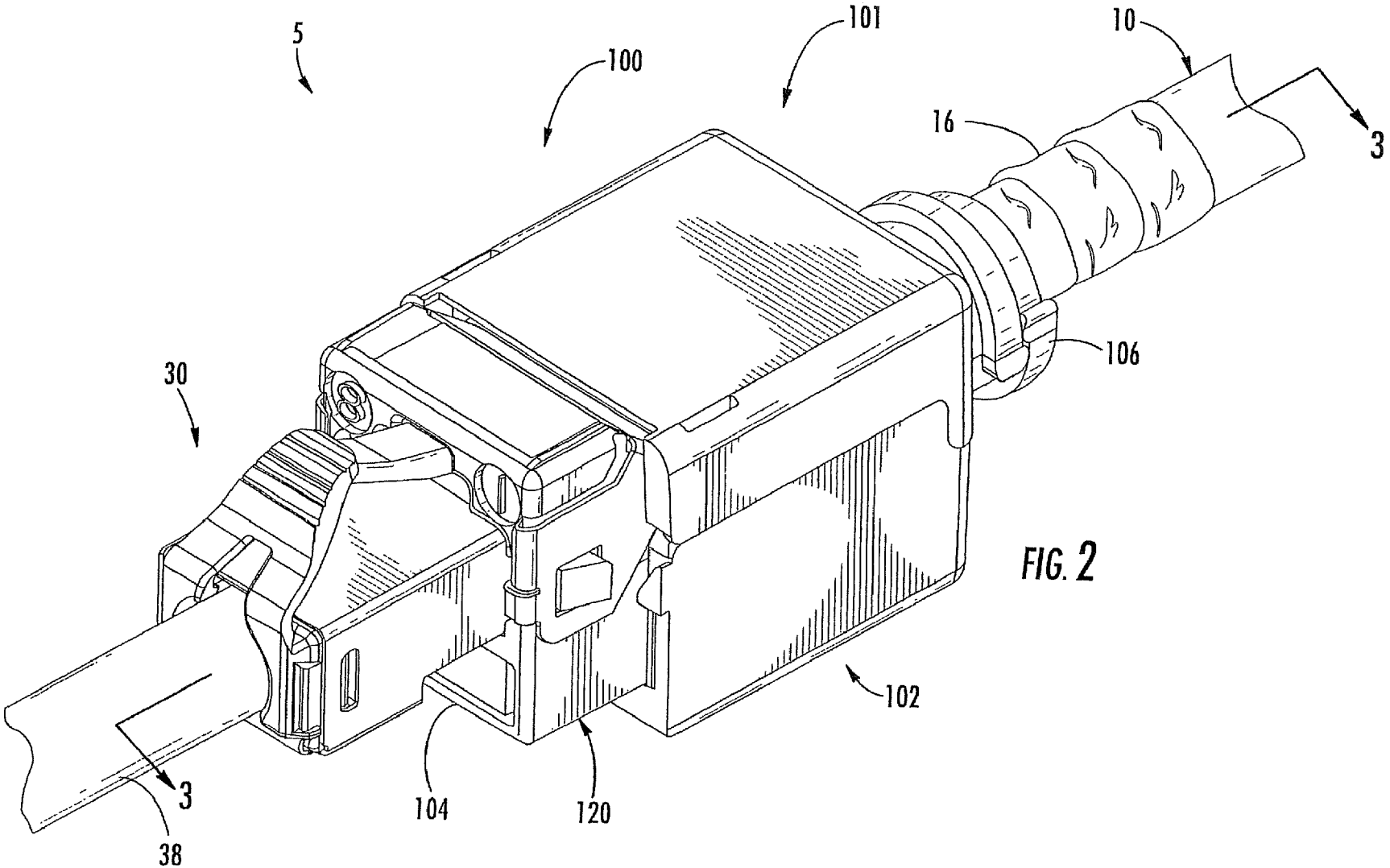
FIG. 2 is a front, perspective view of the connector system of FIG. 1, wherein the plug and the jack assembly are shown in a coupled position.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, the term "drain wire" means an uninsulated wire in a cable that is in contact with a shield of the cable, such as a metal foil or braided tube, throughout a major portion of its length.

With reference to FIGS. 1-8, a shielded jack assembly 100 according to embodiments of the present invention is shown therein. The jack assembly 100 may be operatively connected and mounted on a cable 10 (e.g., an FTP cable) to form a terminated cable 101. The jack assembly 100 is adapted to operatively receive and couple with a modular plug 30 associated with a cable 38 (as shown FIG. 2) to provide continuity between the cables 10 and 38 for transmitting electrical signals, etc., therebetween in known manner. As discussed in more detail below, the jack assembly 100 provides EMI/RFI shielding between the interconnected cables 10, 38. The jack assembly 100 also provides continuity between a drain wire 14 of the cable 10 and a drain wire of the cable 38 and/or a mount panel or the like. The plug 30 may also be shielded. The jack assembly 100 and the plug 30 may together form a connector system 5 (FIGS. 1-3) that may be employed to make connections in structured cabling, for example.

The plug 30 may be a plug assembly constructed as disclosed in Applicants' U.S. Provisional Patent Application Ser. No. 60/578,642, filed Jun. 10, 2004, and as disclosed in Applicants' U.S. patent application Ser. No. 11/137,152, filed May 25, 2005, inventors Gordon et al., the disclosures of which are hereby incorporated herein by reference in their entireties.

The jack assembly 100 has a front end 104 and a rear end 106 and defines an EMI/RFI shield 102 (FIGS. 1 and 3) that extends continuously from the end 104 to the end 106. The jack assembly 100 includes a housing assembly 110 (FIGS. 5 and 6), a can assembly 150 and a jumper member in the form of a jack wrap or clip 170. The housing assembly 110 includes a front inner housing member or jack frame 120, a rear inner housing member or IDC housing 130, and a carrier 140. The can assembly 150 includes a pair of can members 152, 154 that surround the IDC housing 130 and the carrier 140 and a portion of the jack frame 120. The jack wrap 170 extends around a portion of the jack frame 120 and rearwardly into the can assembly 150. As discussed in more detail below, the cable 10 is received through the rear end of the can assembly 150 and engages the carrier 140 and the jack wrap 170.

Figure 4:
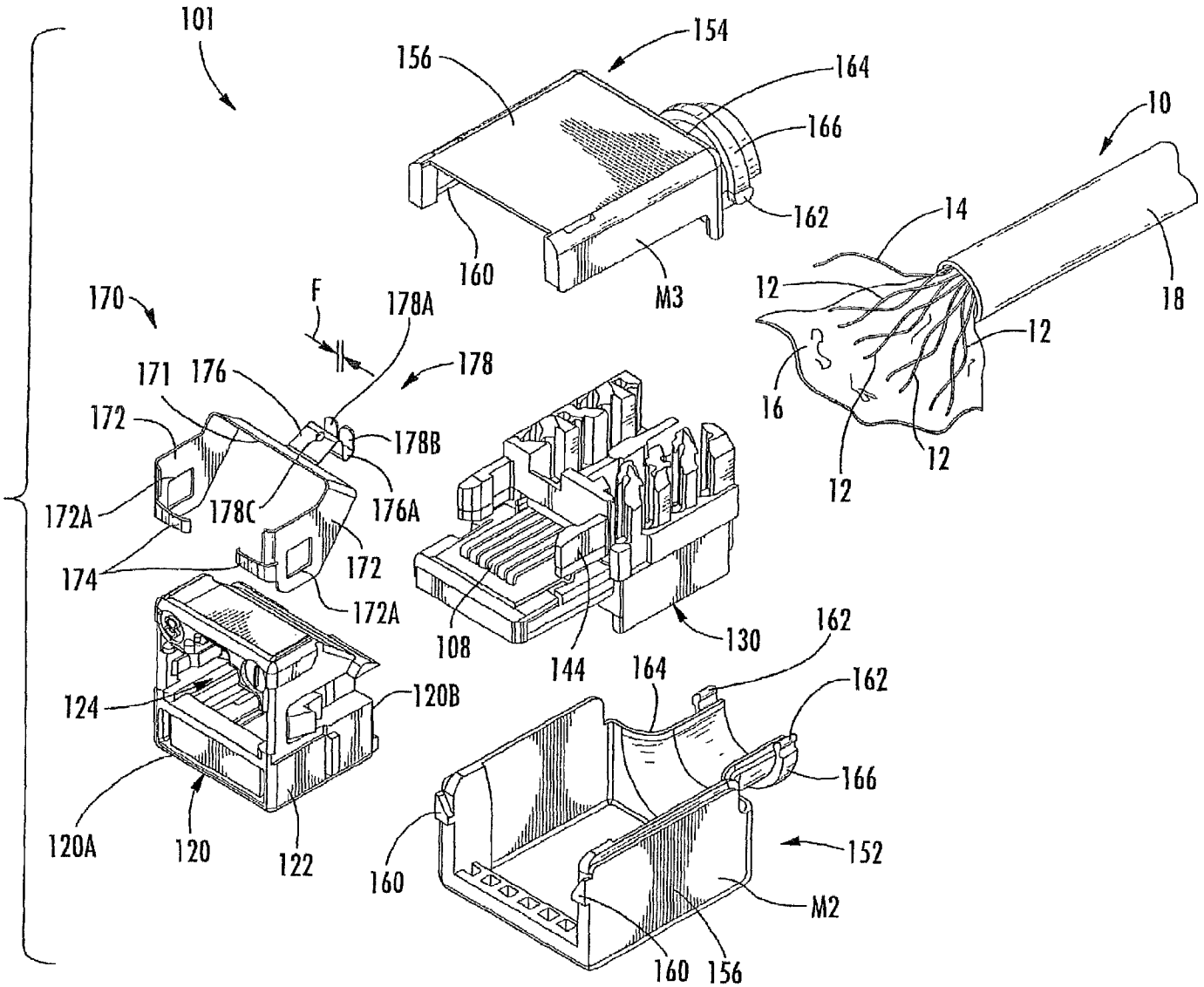
FIG. 4 is an exploded, perspective view of a terminated cable forming a part of the connector system of FIG. 1.

Turning to the jack frame 120 in more detail, the jack frame 120 extends from a front end 120A to a rear end 120B (FIG. 4). The jack frame 120 includes a body 122 defining a socket 124 adapted to receive the plug 130. The body 122 has a latch feature 126A (FIG. 1) in the socket 124 adapted to releaseably engage a latch feature 36 of the plug 30 to secure the plug 30 in the socket 124. Side latch tabs 126B extend laterally from the body 122. The side latch tabs 126B may be adapted to secure the jack assembly 100 in a bezel or mount plate, for example. A latch tab 126C (FIG. 5) extends from the rear end of the body 122 and defines a slot. A metallization layer M1 covers the body 122, as discussed below in more detail.

Figure 5:
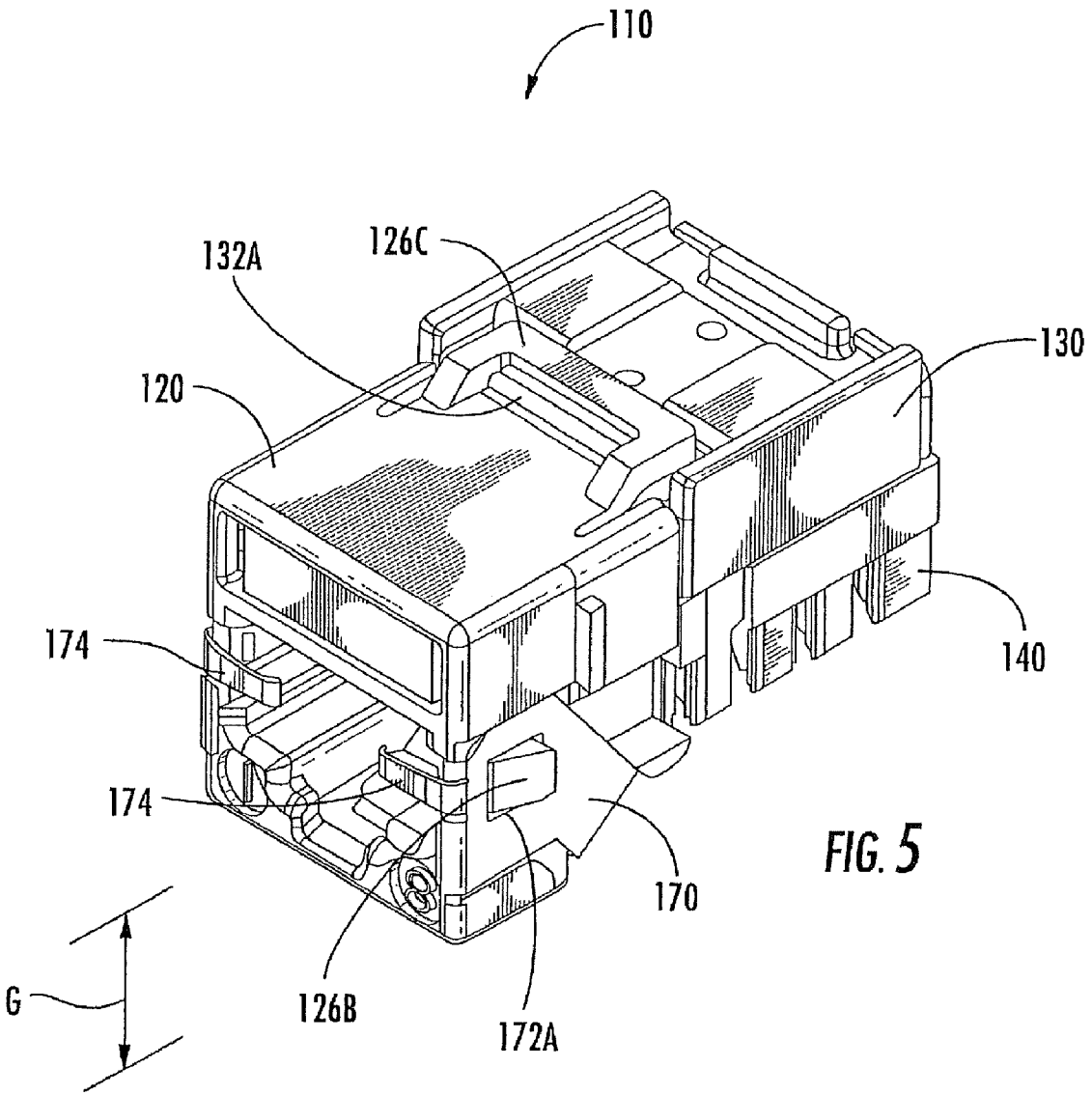
FIG. 5 is a front, bottom, perspective view of a housing assembly forming a part of the jack assembly of FIG. 1.

The IDC housing 130 is coupled to the jack frame 120 by a tab 132A that engages the slot in the tab 126C (FIG. 5).

Figure 3:
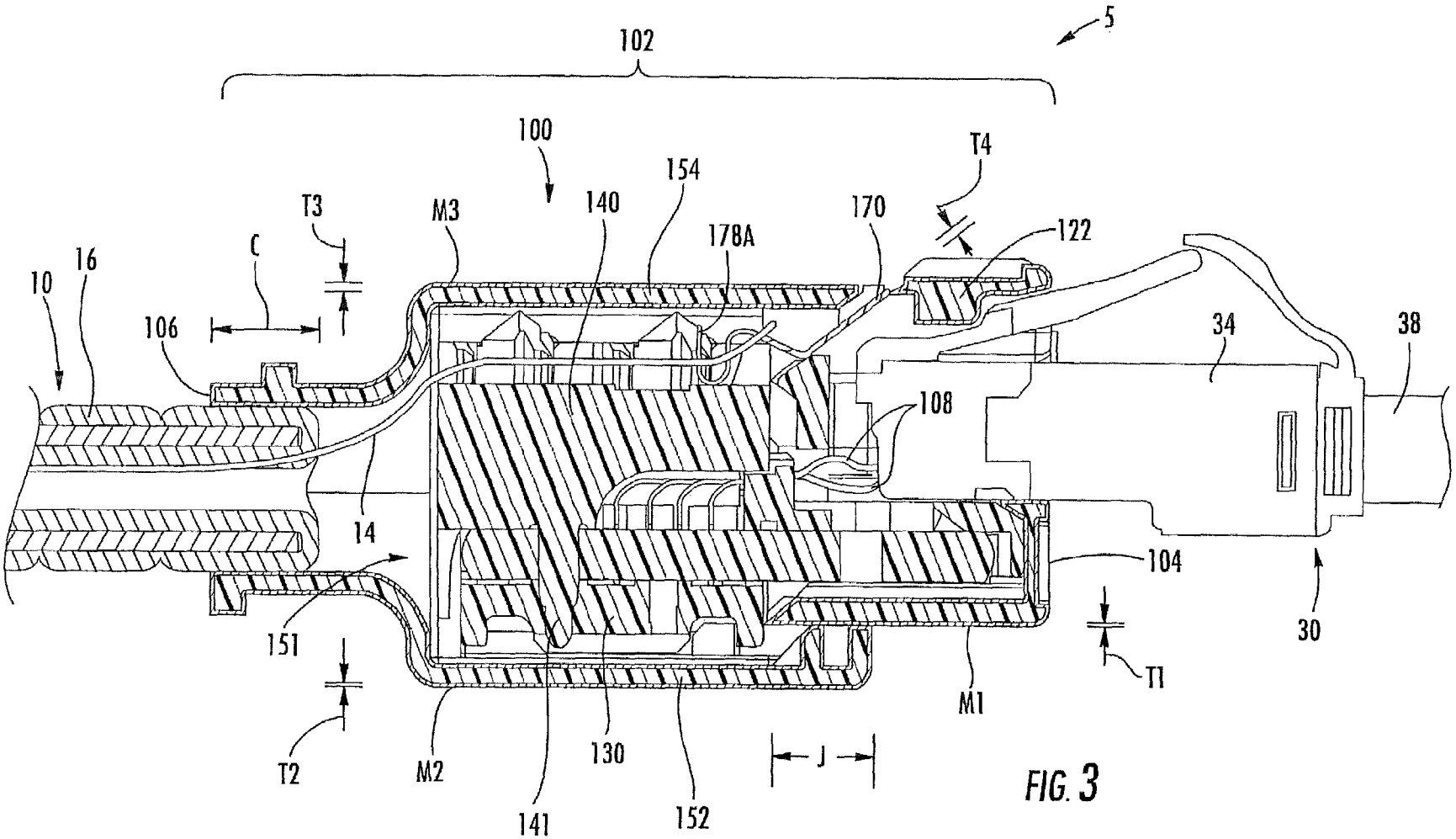
FIG. 3 is a partial cross-sectional view of the connector system of FIG. 1 taken along the line 3-3 of FIG. 2.

The carrier 140 is secured to the IDC housing 130 by a post 141 (FIG. 3). The carrier 140 is secured to the jack frame 120 by clips 144 (FIG. 4). The carrier 140 defines slots 142 to receive conductor members 12 of the cable 10. Insulation displacement connectors (IDC's) or the like are disposed in the slots 142 and provide electrical connections between the conductor members and respective contacts 108 (FIG. 1) mounted on the carrier 140. The contacts 108 are configured and positioned in the socket 124 to engage corresponding contacts of the plug 30 when the plug 30 is mated to the jack assembly 100.

With reference to FIG. 1, the can members 152, 154 define a front end 150A, a rear end 150B, a front opening 150C and a rear cable opening 150D of the can assembly 150. Each of the can members 152, 154 includes a body 156, a latch 160 to secure the can member 152, 154 to the jack frame 120, a latch 162 to secure one can member to the other can member, a neck 164, and a flange 166. The can member 152 has a metallization layer M2 covering its body 156. The can member 154 has a metallization layer M3 covering its body 156. The can assembly 150 defines a chamber 151 (FIG. 3) that holds the housing assembly 110.

As best seen in FIG. 4, the jack wrap 170 includes a top band or body 171 and spaced apart side walls 172 extending forwardly from either end of the body 171. Latch apertures 172A are defined in the side walls 172 and receive the latch features 126B to secure the jack wrap 170 to the jack frame 120. Bendable spring tabs 174 extend inwardly from the side walls 172 into or across the socket 124. A bridge portion 176 extends rearwardly from the body 171 to a pair of connector tabs 178A defining a slot 178B therebetween. The connector tabs 178A and the slot 178B may be generally configured as an IDC. A second slot 178C is defined in the bridge portion 176. A trough 176A is formed in the bridge portion 176.

According to some embodiments of the present invention, the length E (FIG. 6) of the tabs 178A is between about 0.130 and 0.125 inch. According to some embodiments, the nominal width F (FIG. 4) of the slot 178B is between about 0.005 and 0.015 inch. According to some embodiments and as shown, the depth of the trough 176A is substantially the same as the length of the tabs 178A.

According to some embodiments, the nominal thickness T4 (FIG. 3) of the jack wrap 170 is between about 0.012 and 0.008 inch. According to some embodiments, the width G (FIG. 5) of the side walls 172 is between about 0.325 and 0.315 inch and the width H (FIG. 6) of the body 171 is between about 0.185 and 0.195 inch.

The jack wrap 170 may be formed of any suitable electrically conductive material. According to some embodiments, the jack wrap 170 is formed of a metal such as steel. The jack wrap 170 may be formed by any suitable method, such as stamping from a metal sheet.

The body 122, the IDC housing 130, the carrier 140 and the can member bodies 156 may be formed of any suitable dielectric or electrically insulating or non-conductive material. Suitable materials include polymeric or plastic materials such as polycarbonate, ABS, and/or PC/ABS blend. The members 122, 130, 140 and 156 may be molded. According to some embodiments, each of the members 122, 130, 140 and 156 comprises an integral and unitary piece.

The metallization layers M1, M2, M3 may be applied to the respective members 120, 156 by any suitable means. The metallization layers M1, M2, M3 may cover only the outer surfaces of the members 122, 156, only the inner surfaces of the members 122, 156, or, as shown, both the inner and outer surfaces of the members 122, 156. The metallization layers M1, M2, M3 are bonded to the surfaces of the members 122, 156. The metallization layers M1, M2, M3 may be formed of any suitable material such as stainless steel, gold, nickel-plated copper, silver, silvered copper, nickel, nickel silver, copper or aluminum. The metallization layers M1, M2, M3 may be formed and applied by any suitable techniques. Suitable techniques may include electroless coating, electroplated coating, conductive paint, and/or vacuum metalizing. According to some embodiments, the metallization layers M1, M2, M3 are layers of nickel-plated copper applied using electroless plating.

According to some embodiments and with reference to FIG. 3, the metallization layers M1, M2, M3 each have a thickness T1, T2, T3 of no more than about 240 micro inches. According to some embodiments, the thicknesses T1, T2, T3 are between about 20 and 240 micro inches. According to some embodiments, the thicknesses T1, T2, T3 are between about 40 and 120 micro inches.

In accordance with embodiments of the invention, the jack assembly 100 can be assembled and mounted on the cable 10 in the following manner. The cable 10 may be any suitable type of cable. As shown, the cable 10 includes a jacket 18 and a plastic film tube surrounding the drain wire 14, a tubular shield sleeve 16, and a plurality of twisted pairs of conductor members 12 (for clarity, the conductor members 12 are not shown in FIG. 3). The shield sleeve 16 as illustrated is a metal foil shield (e.g. a metal foil laminated to a plastic film backing); however, the shield sleeve 16 can be a braided metal shield tube or the like. The conductor members 12 may each include an electrical conductor surrounded by a respective layer of insulation. It will be appreciated that other types of cables may be employed.

The carrier 140 may be secured to the IDC housing 130 and then to the jack frame 120 by engaging the tabs 126C with the clip tab 132A and engaging the clips 144 with corresponding openings in the jack frame 120 to form the housing assembly 110. The jack wrap 170 may then be mounted on the housing assembly 110 and secured in place by engaging the side latch tabs 126B with the apertures 172A.

Figure 6:
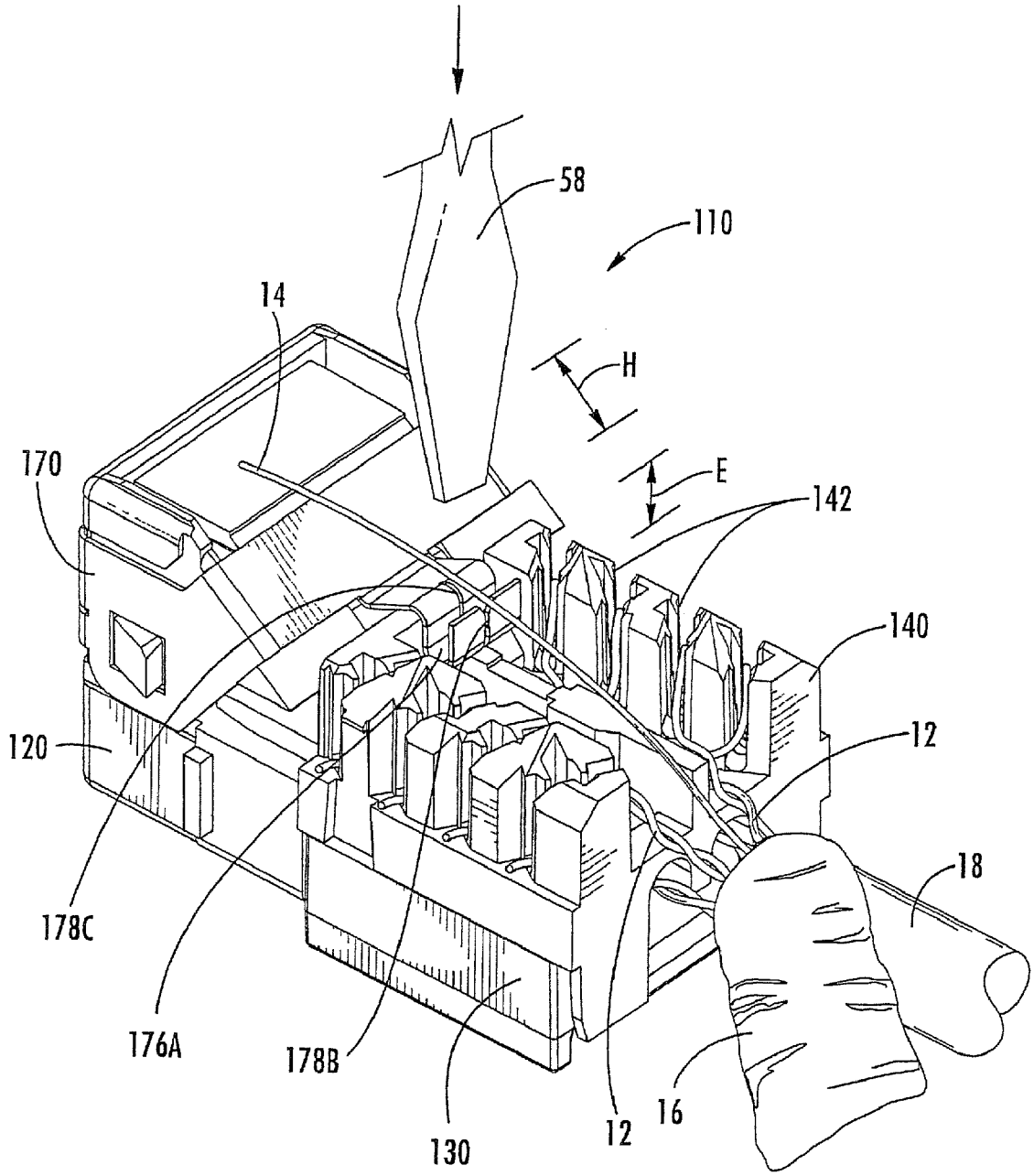
FIG. 6 is a rear, perspective view of a portion of the jack assembly of FIG. 1 and a cable partially installed therein.

The jacket 18 of the cable is pulled back or trimmed and the foil 16 is folded back so that the conductor members 12 are exposed. As shown in FIG. 6, the conductor members 12 are laced into the slots 142 and forced into engagement with the IDC's located therein using a tool or cap, for example. In FIG. 6, the conductor members 12 are shown after trimming excess wire length.

Figure 7:
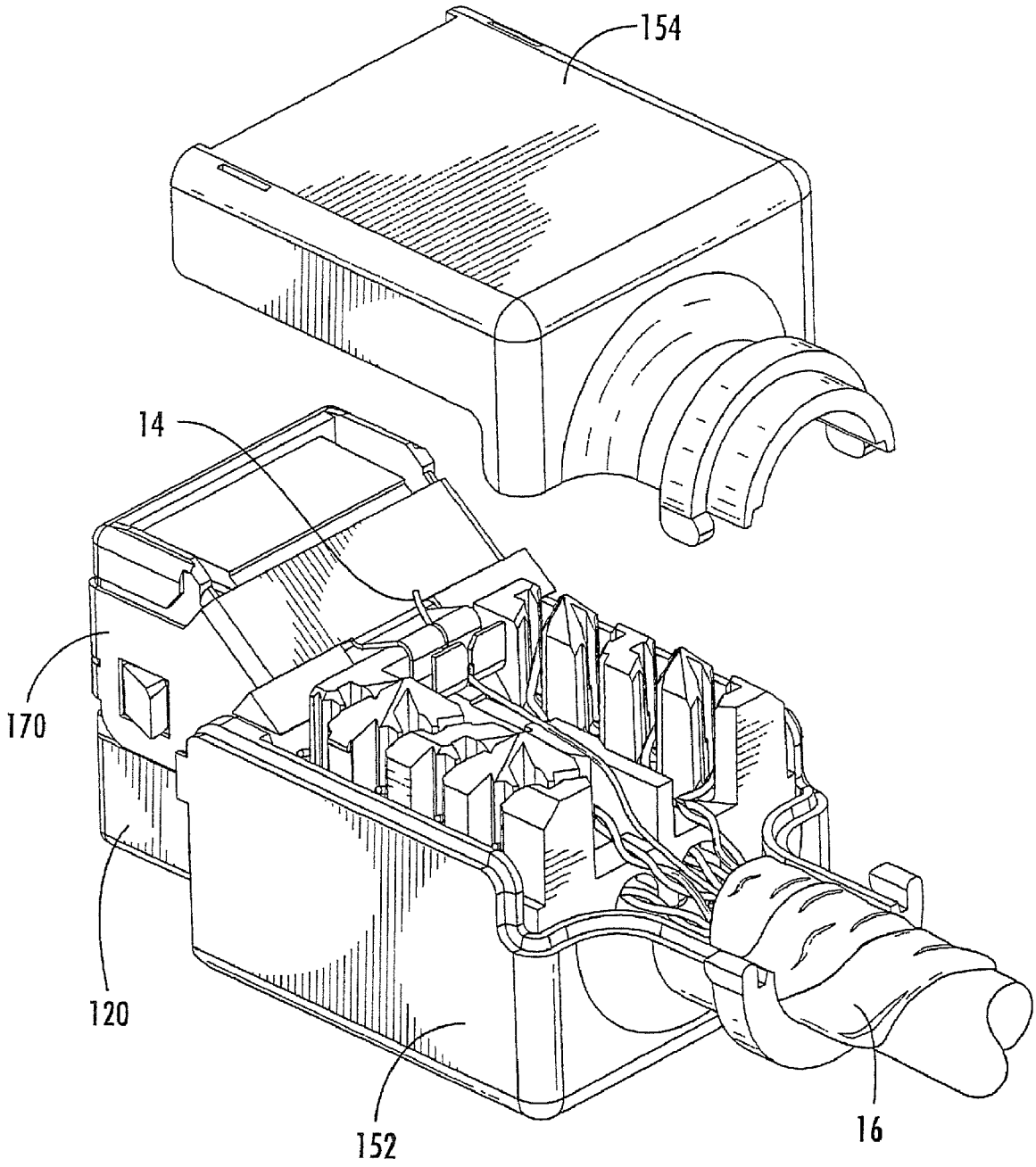
FIG. 7 is a rear, perspective, partially exploded view of the jack assembly of FIG. 1 with the cable installed therein.

The drain wire 14 is routed over the slot 178B of the IDC 178. The drain wire 14 is forced into the slots 178B, 178C so that the drain wire 14 is captured by the IDC 178 as shown in FIG. 7. The drain wire 14 may be forced into the IDC 178 by pushing the drain wire 14 into the trough 176A using a tool such as a screwdriver 58. The drain wire 14 may then be trimmed as shown in FIG. 7.

The can members 152, 154 are then installed over the housing assembly 110 such that the latches 160 interlock with the jack frame 120 and the latches 162 interlock with one another. The rear opening 150D may be sized to form an interference fit with the cable 10.

Figure 8:
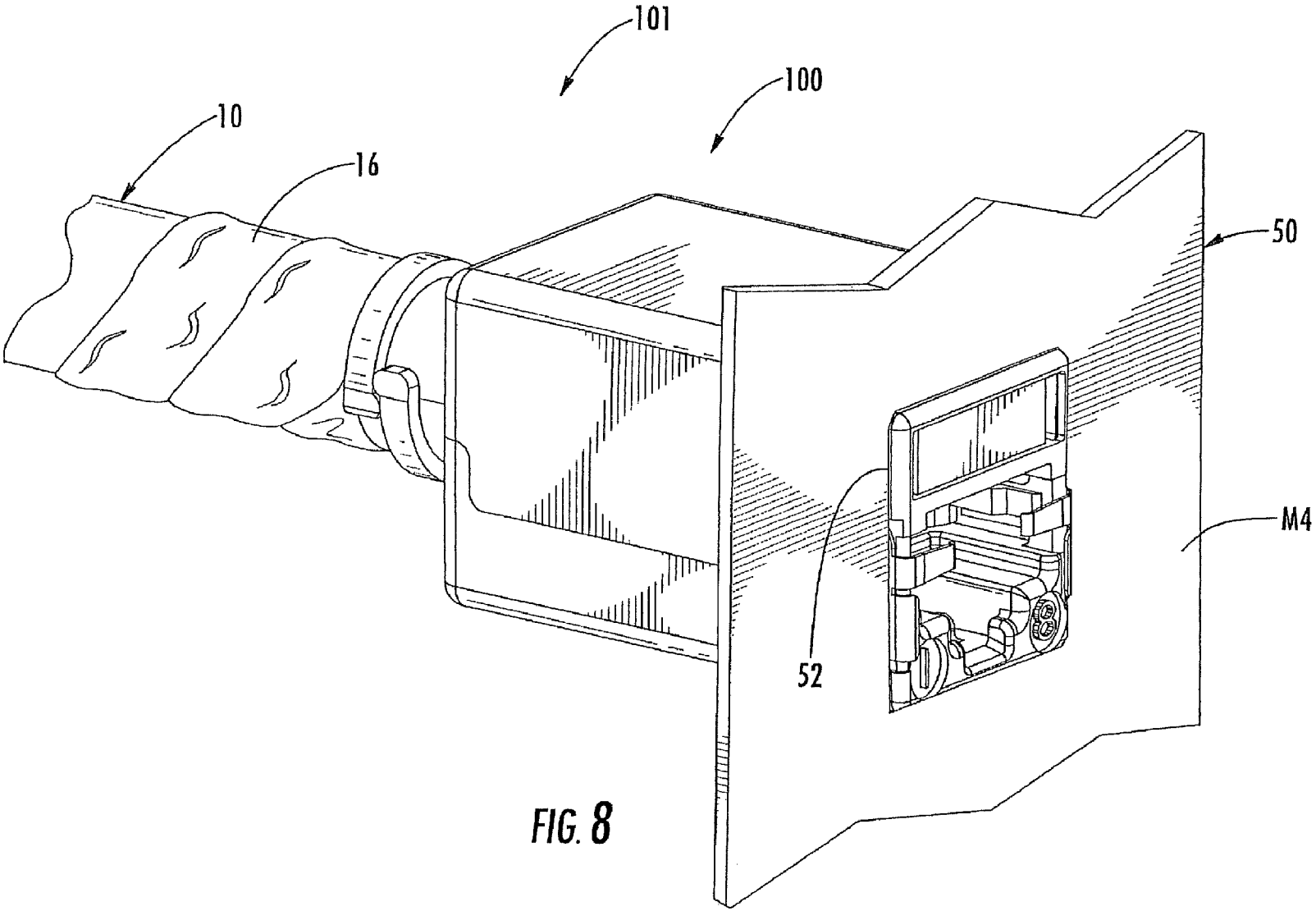
FIG. 8 is a front, perspective view of the terminated cable of FIG. 4 mounted in a mount panel.

The terminated cable 101 can be mounted in an opening 52 of a mount panel 50, such as a patch panel, as shown in FIG. 8. The latch tabs 126B may interlock with corresponding latch features (not shown) of the mount panel 50. The mount panel 50 may include a metallization layer M4 or other grounding layer or structure. The metallization layer M4 may be grounded via a rack or the like. The side walls 172 may engage the metallization layer M4 when the jack assembly 100 is mounted in the opening 52 so that electrical continuity is provided between the drain wire 14 and the metallization layer M4.

As discussed above, the jack assembly 100 provides a shielded termination and connection. The metallization layers M1, M2, M3 serve as metal shield layers that, in combination, extend from the front end 104 to the rear end 106. The shield formed by the metallization layer M1 is tubular. Likewise, the metallization layers M2 and M3 in combination form a tubular shield.

As shown, the layers M2, M3 may overlap portions of the layer M1. According to some embodiments, the length of overlap J (FIG. 3) is at least 0.20 inch. The jack wrap 170 may also form a part of the tubular shield 102. The can assembly 150 overlaps and contacts the foil 16 of the cable 110 to provide electrical continuity between the foil 16 and the can assembly 150. The overlap between the foil 16 and the can assembly 150 also provides overlap between the tubular shields defined by the foil 16 and the can assembly 150 to ensure continuity of the shield. According to some embodiments, the can assembly 150 overlaps the foil 16 a distance C of at least 0.25 inch (FIG. 3).

In the foregoing manner, the jack assembly 100 provides a substantially continuous tubular shield 102 that extends from the front end 104 to the rear end 106 at or overlapping the foil 16. That is, 360 degrees of shielding is provided from the end 104 to the end 106. According to some embodiments, the shield 102 extending from the end 104 to the end 106 (FIGS. 1 and 3) is at least about 80% complete (i.e., free of openings). According to some embodiments, the shield 102 is at least about 95% complete from the end 104 to the end 106.

The shields formed by the metallization layers M1, M2, M3 may be grounded in any suitable manner. The drain wire 14 of the cable 10 and/or the drain wire of the cable 38 may lead to ground. The metallization layers M2, M3 contact the foil 16 to provide electrical continuity therewith. The metallization layer M1 may contact one or both of the metallization layers M2, M3 and/or the jack wrap 170 to provide a connection to ground.

The jack wrap 170 provides electrical continuity between the drain wire 14 and the tabs 174 in the socket 124. The tabs 174 are adapted to engage corresponding portions of a plug wrap 34 on a housing 32 of the plug 30. The tabs 174 may be spring biased to ensure positive and adequate contact between the tabs 174 and the plug wrap 34. The plug wrap 34 is in turn electrically connected to a drain wire of the cable 38. In this manner, the connector system 5 provides electrical continuity between the respective drain wires of the cables 10 and 38, either or both of which may lead to ground. The jack wrap 170 may also provide electrical continuity with the metallization layer M4 or other grounding structure of the mount panel 50.

The jack wrap 170 may be constructed to meet conventionally required or desired drain wire continuity standards. According to some embodiments, the jack wrap 170 introduces a resistance of no more than about 20 milliohms from the drain wire 14 to the contact tabs 174. According to some embodiments, the jack wrap 170 and the plug wrap 34 in combination introduce a resistance of no more than about 40 milliohms from the drain wire 14 to the drain wire of the cable 38. According to some embodiments, the jack wrap 170 introduces a resistance of no more than about 1 ohm from the drain wire 14 to the portions of the side walls 172 configured to engage the grounding layer or structures of the mount panel 50.

Notably, the relatively thin metallization layers M1, M2, M3 alone may not be capable of providing sufficient or standards compliant continuity between the drain wire 14 and the socket 124 or the mount panel 50. Rather, this function may be primarily or substantially entirely served by the jack wrap 170.

In accordance with some embodiments, the jack wrap 170 provides only a minority of the EMI/RFI shielding of the jack assembly 100. Rather, the shielding function is primarily served by the relatively thin and lightweight metallization layers M1, M2, M3. The drain wire 14 is thus terminated to a different component than that providing the majority of the shielding. According to some embodiments, the jack wrap 170 surrounds less than 50% of the jack assembly 100 from the front end 104 to the foil 16. According to some embodiments, the jack wrap 170 surrounds less than 15%.

The jack assembly 100 may comprise a modular jack that complies with applicable standards. The jack assembly 100, the terminated cable 101 and the connector system 5 of the present invention may be particularly suitable for use in high speed data transmission lines, for example, of the type including shielded twisted wire pairs (e.g., FTP cables). However, the jack assemblies, terminated cables and connector systems of the present invention may be used for other types of cables as well. The jack assembly 100 may be a RJ-type jack. According to some embodiments, the jack assembly 100 is an RJ45 jack and the socket 124 is an RJ45 opening (i.e., is configured to operatively receive an RJ45 modular plug). According to some embodiments, the jack assembly 100 complies with the standards of at least one of the following: the International Electrotechnical Commission (IEC), the Telecommunications Industry Association (TIA), and the Electronics Industries Alliance (EIA). According to some embodiments, the jack assembly 100 complies with at least one of the foregoing standards as applicable for RJ45 jacks.

The jack assembly 100 may provide a number of advantages over known jack assemblies. The metallization layers M1, M2, M3 and the relatively small jack wrap 170 may be applied to various geometries of jack housings. The metallization layers can be easily applied to different geometries and do not add substantially to the dimensions or weights of the housing members. Thus, housings meeting a given standard can be metalized to provide shielding without having to modify the configuration of the housings. Likewise, the jack wrap 170 can be adapted to fit or retro-fitted to various housings so that the housings need not be modified. The use of metalized plastic parts may provide significant cost savings as compared to formed metal jack wrap shields, for example.

In accordance with further embodiments of the invention, various modifications may be made to the foregoing methods and devices and various features or aspects thereof may be employed without the other(s). For example, one or more of the metallization layers M1, M2, M3 can be replaced or supplemented with metal shield components otherwise formed. For example, according to some embodiments, the metal shield layers can take the form of one or more stamped metal wraps. Similarly, according to some embodiments, the jack wrap 170 may be replaced with a jack wrap including a post or the like in place of the IDC 178.

Figure 9:
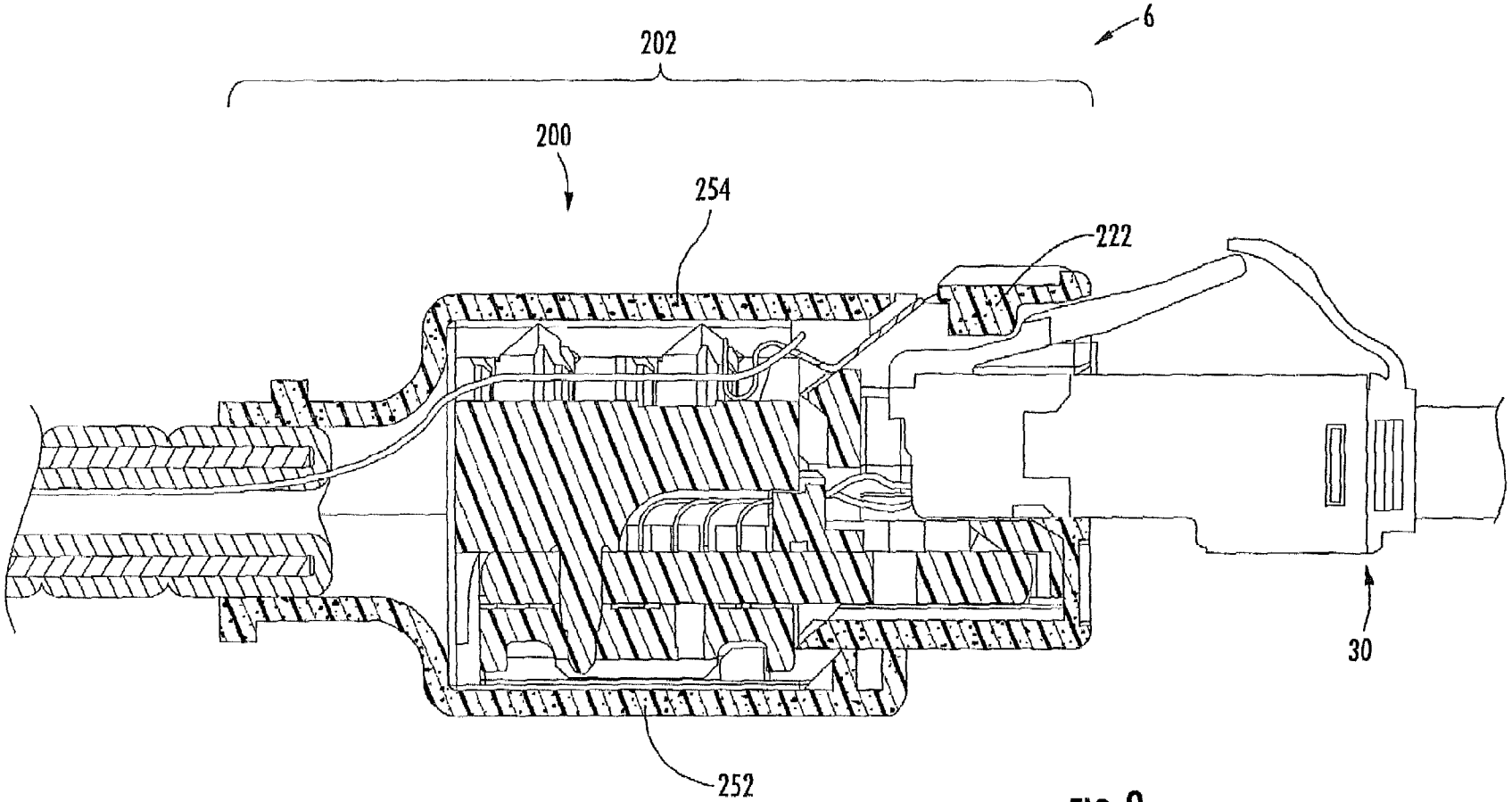
FIG. 9 is a partial cross-sectional view of a connector system according to further embodiments of the present invention.

With reference to FIG. 9, a connector system 6 including a jack assembly 200 according to further embodiments of the present invention is shown therein. The jack assembly 200 is constructed in the same manner as the jack assembly 100 except as follows. The metallization layers M1, M2, M3 are omitted. The jack frame body 222, the can member 252, and the can member 254 are each formed of an electrically conductive metal-filled polymer composite material. The metal-filled polymer components 222, 252, 254 provide an EMI/RFI shield 202 corresponding to the shield 102.

The metal-filled polymers of the components 222, 252, 254 may be the same or different. Any suitable polymers and metals may be employed. The ratio of the metal filler to the polymer may be at any suitable level. Suitable polymers may include polycarbonate, ABS, and/or a PC/ABS blend. Suitable metals may include stainless steel, nickel, and/or copper. The amount or density and distribution of the metal in the metal-filled polymer should be sufficient to provide electrical continuity required to provide the desired level of EMI/RFI shielding.

One or more of the components 222, 252, 254 may be additionally provided with a metallization layer corresponding to the metallization layer M1, M2, or M3. Aspects of the jack frame assemblies 100, 200 may be combined such that one or more of the components 222, 252, 254 are formed of a metal-filled polymer and one or more are provided with a metallization layer instead.

According to some embodiments, the jack wrap (e.g., the jack wrap 170) may be replaced or supplemented with a jumper member that does not wrap about and/or clip onto the housing assembly (e.g., the housing assembly 110). For example, the jumper member may extend through the housing assembly.

Shielded jack assemblies according to the present invention may be formed so as to be watertight or water-resistant. According to some embodiments, a rubber gasket is provided between the can members 152, 154 and/or the jack frame 120, for example.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A jack assembly for use with a modular electrical plug, the jack assembly comprising:

a) a jack housing including an electrically non-conductive substrate metalized with a metal metallization shield layer, the jack housing defining a socket adapted to receive the plug;

b) at least one electrical contact positioned in the socket to engage the plug when the plug is inserted in the socket; and c) an electrically conductive jumper member mounted on the jack housing, wherein the jumper member is adapted to couple with a drain wire of a cable, and wherein the jumper member is separately formed from the metallization shield layer.

2. The jack assembly of claim 1 wherein the metallization shield layer forms a tubular, electrically conductive EMI/RFI jack shield.

3. The jack assembly of claim 1 wherein the socket is adapted to receive an RJ-type plug.

4. The jack assembly of claim 1 wherein the jumper member includes a jack wrap having a body surrounding at least a portion of the jack housing.

5. The jack assembly of claim 1 wherein the jumper member includes a drain wire connector, the drain wire connector including a pair of connector tabs defining a slot therebetween to receive and hold the drain wire.

6. The jack assembly of claim 1 wherein the jumper member is unitary.

7. The jack assembly of claim 1 wherein the jumper member is formed of metal.

8. The jack assembly of claim 1 wherein the metallization shield layer has a thickness of no more than about 240 micro inches.

9. The jack assembly of claim 8 wherein the metallization shield layer has a thickness of between about 40 and 120 micro inches.

10. The jack assembly of claim 1 wherein the jack housing is adapted to receive a cable such that a shield sleeve of the cable engages the metallization shield layer to form a continuous EMI/RFI shield including the shield sleeve and the metallization shield layer.

11. The jack assembly of claim 10 wherein:

the jack housing includes a tubular, electrically conductive EMI/RFI jack shield extending at least from the shield sleeve to a front opening of the socket when the cable is installed in the jack assembly; and the EMI/RFI jack shield includes the metal shield layer.

12. A method for making a jack assembly for use with a modular electrical plug, the method comprising:

a) metalizing an electrically non-conductive substrate to form a metalized jack housing with a metal metalizing shield layer, the jack housing defining a socket adapted to receive the plug;

b) positioning at least one electrical contact in the socket to engage the plug when the plug is inserted in the socket; and c) mounting an electrically conductive jumper member on the jack housing, wherein the jumper member is adapted to couple with a drain wire of a cable, and wherein the jumper member is separately formed from the metal shield layer.

13. A method for making a jack assembly for use with a modular electrical plug, the method comprising:

a) forming a jack housing including a metal-filled polymer, the jack housing defining a socket adapted to receive the plug;

b) positioning at least one electrical contact in the socket to engage the plug when the plug is inserted in the socket; and c) mounting an electrically conductive jumper member on the jack housing, wherein the jumper member is adapted to couple with a drain wire of a cable, and wherein the jumper member is separately formed from the metal-filled polymer.

14. A jack assembly for use with a modular electrical plug, the jack assembly comprising:

a) a jack housing including a metal-filled polymer, the jack housing defining a socket adapted to receive the plug; and b) at least one electrical contact positioned in the socket to engage the plug when the plug is inserted in the socket;

wherein the jack housing includes a jack frame body defining the socket and a can member separately formed from the jack frame body, and the can member is formed of the metal-filled polymer.

15. A jack assembly for use with a modular electrical plug, the jack assembly comprising:

a) a jack housing including a metal-filled polymer, the jack housing defining a socket adapted to receive the plug;

b) at least one electrical contact positioned in the socket to engage the plug when the plug is inserted in the socket; and c) an electrically conductive jumper member mounted on the jack housing, wherein the jumper member is adapted to couple with wire of a cable, and wherein the jumper member is separately formed from the metal-filled polymer.

16. The jack assembly of claim 15 wherein the metal-filled polymer includes a metal filler selected from the group consisting of stainless steel, nickel and/or copper.

17. The jack assembly of claim 15 wherein the metal-filled polymer surrounds the socket.

* * * * *

UNITED STATES PATENT AND TRADEMARK OFFICE

CERTIFICATE OF CORRECTION

PATENT NO. : 7,510,439 B2
APPLICATION NO. : 11/766450
DATED : March 31, 2009
INVENTOR(S) : Gordon et al.

It is certified that error appears in the above-identified patent and that said Letters Patent is hereby corrected as shown below:

In the Claims:

Column 10, Claim 11, Line 3: Please correct “metal” to read -- metallization --

Column 10, Claim 12, Line 16: Please correct “metal” to read -- metallization --

Column 10, Claim 15, Line 51: Please correct “with wire” to read -- with a drain wire --

Signed and Sealed this

Ninth Day of June, 2009

JOHN DOLL
*Acting Director of the United States Patent and Trademark Office*